US005215326A

United States Patent [19]

Baron et al.

[11] Patent Number: 5,215,326

[45] Date of Patent: Jun. 1, 1993

[54] DEPRESSIBLE SOLE SUPPORT FOR A SKI BOOT

[75] Inventors: Pascal Baron, Annecy; Jean-Pierre Boussemart, Choisy, both of France

[73] Assignee: Salomon S.A., Annecy Cedex, France

[21] Appl. No.: 627,743

[22] Filed: Dec. 14, 1990

[30] Foreign Application Priority Data

Dec. 18, 1989 [FR] France ..... 89 16868

[51] Int. Cl.[5] ..... A63C 9/085

[52] U.S. Cl. ..... 280/636; 280/607

[58] Field of Search ..... 280/607, 617, 618, 633, 280/636, 629, 626, 634, 630

[56] References Cited

U.S. PATENT DOCUMENTS

| | | | |
|---|---|---|---|
| 4,139,214 | 7/1979 | Meyer | 280/607 |
| 4,561,673 | 12/1985 | Pascal et al. | 280/636 |
| 4,586,727 | 5/1986 | Andrieu et al. | 280/607 |
| 4,784,404 | 11/1988 | Kowatsch | 280/636 |
| 4,984,816 | 1/1991 | Rullier | 280/636 |

FOREIGN PATENT DOCUMENTS

| | | |
|---|---|---|
| 2715425 | 10/1978 | Fed. Rep. of Germany . |
| 3142623 | 5/1983 | Fed. Rep. of Germany . |
| 3230186 | 2/1984 | Fed. Rep. of Germany . |
| 2458299 | 1/1981 | France . |
| 2473328 | 7/1981 | France . |
| 2555457 | 5/1985 | France . |

*Primary Examiner*—Richard M. Camby
*Attorney, Agent, or Firm*—Sandler Greenblum & Bernstein

[57] ABSTRACT

The invention relates to a safety binding which is adapted to retain the front end of a boot. More precisely, the invention relates to a support element on which rest the front end of the boot. The support element has a base plate and a support plate which are continuously connected, through a elastically deformable zone. An abutment limits the upward movement of the support plate, and a groove limits its downward movement.

28 Claims, 4 Drawing Sheets

FIG: 1
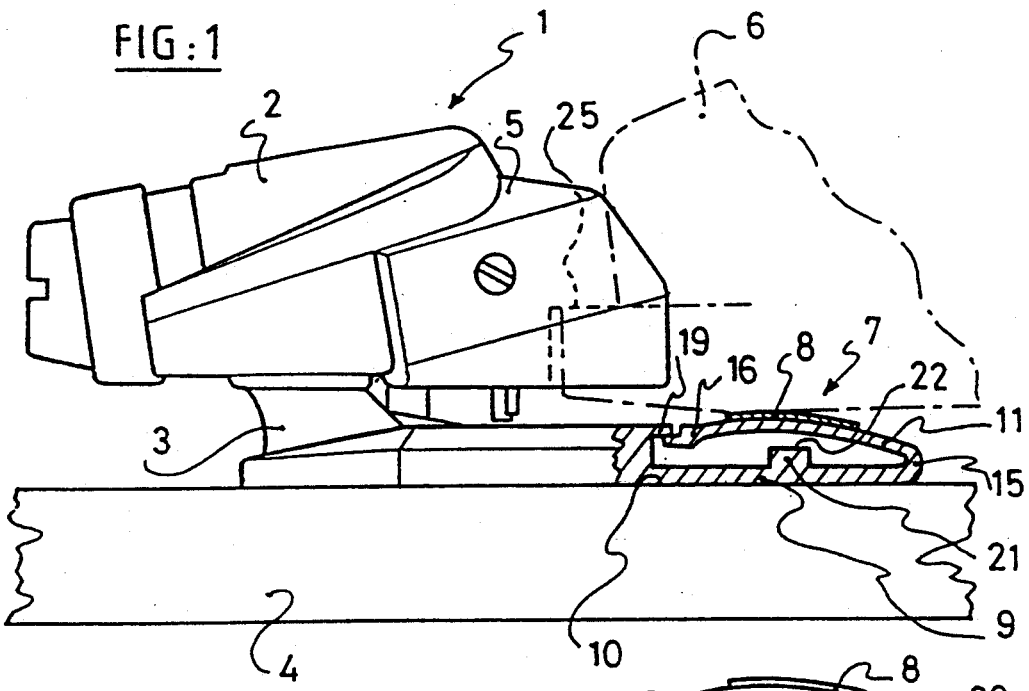
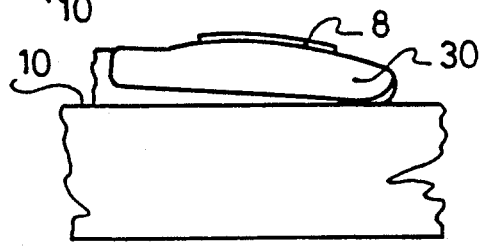
FIG: 3
FIG: 2
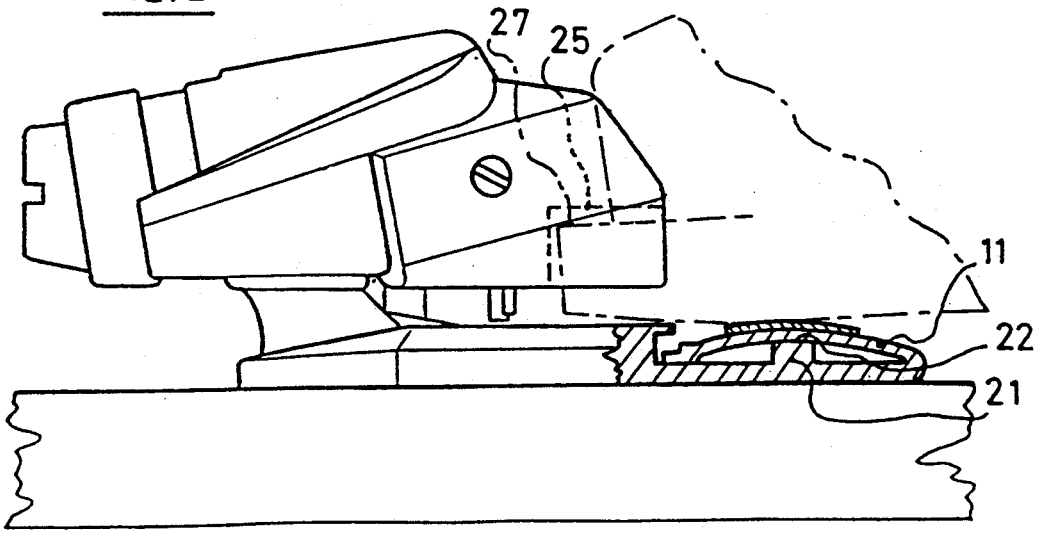

DEPRESSIBLE SOLE SUPPORT FOR A SKI BOOT

BACKGROUND OF THE INVENTION

1. Field of the Invention

The invention relates to a safety binding which is adapted to retain the front end of a boot on the ski, and to free this end of the boot when it exerts an excessive bias on the binding.

More particularly, the invention relates to a support element whose front binding is equipped, i.e., the plate which is generally positioned on the rear of the front binding, and on which rests the sole of the boot.

2. Description of Background and Relevant Information

In a conventional manner, the front of a ski boot is retained in a safety binding jaw. The jaw comprises a sole holder which covers at least partially the upper surface of the front end of the sole, and retains the sole of the boot supported against the support element.

In a vertical direction the front of the sole of the boot is thus engaged between the support element and the sole holder.

It is known that soles can have different thickness by virtue of their tolerances of manufacture. Likewise, the soles of boots adapted to children or young adults (junior soles) have a smaller thickness than the sole of boots adapted to adults (senior soles).

In a manner so as to allow for the adaptation of the binding to soles of different thickness, it is known to equip the sole holder with height adjustment means. Such an adjustment means is for example described in French Patent 2,458,299.

Likewise, French Patent 2,555,457 discloses a support element whose upper surface is adjustable in height in a manner so as to compensate for variations in thickness of the sole. These two modes of adjustment give good result, but they require manual intervention.

Thus, a binding which has been initially adjusted for a junior sole necessarily requires manual adjustment if it is to be utilized thereafter with a senior sole. Otherwise, the front end of the sole is tightly pinched between the support element and the sole holder which causes a very substantial increase in the release values, i.e. the force that the boot must overcome to be freed.

SUMMARY OF THE INVENTION

It is one of the objects of the present invention to overcome the above disadvantages by providing a support element which avoids excessive pinching of the sole of the boot, whatever its thickness.

Another object of the invention is to provide a support element which, is of particularly simple construction.

Other objects and advantages of the invention will become clear from the description which follows.

The safety binding according to the invention is adapted to retain the front end of a boot on a ski and to free this end of the boot when it exerts an excessive bias on the binding. It comprises a retention element for retaining the end of the boot, and furthermore comprises a support element wedged between the sole of the boot and the ski on which the sole of the boot rest.

The safety binding is characterized by the fact that the support element has a support plate on which the sole rests, and the base plate which is supported against the upper surface of the ski, and that the support plate and the base plate are superimposed and connected to one another in a continuous manner at least at the level of one of their respective longitudinal edges by an elastically deformable zone forming an elastic hinge, and biasing the support plate upwardly, in a manner such that, under the effect of a downward vertical force, the support plate is lowered in the direction of the base plate against the return force of the elastically deformable zone.

BRIEF DESCRIPTION OF THE DRAWINGS

The invention will be better understood with reference to the description which follows of a plurality of non-limiting embodiments, given by way of example only, as well as to the annex drawings in which:

FIG. 1 illustrates a side partial view of a front binding having a support element according to the invention;

FIG. 2 illustrates the operation of the support element of FIG. 1;

FIG. 3 illustrates one embodiment of the support element of FIG. 1;

DESCRIPTION OF PREFERRED EMBODIMENTS

Figure 4:
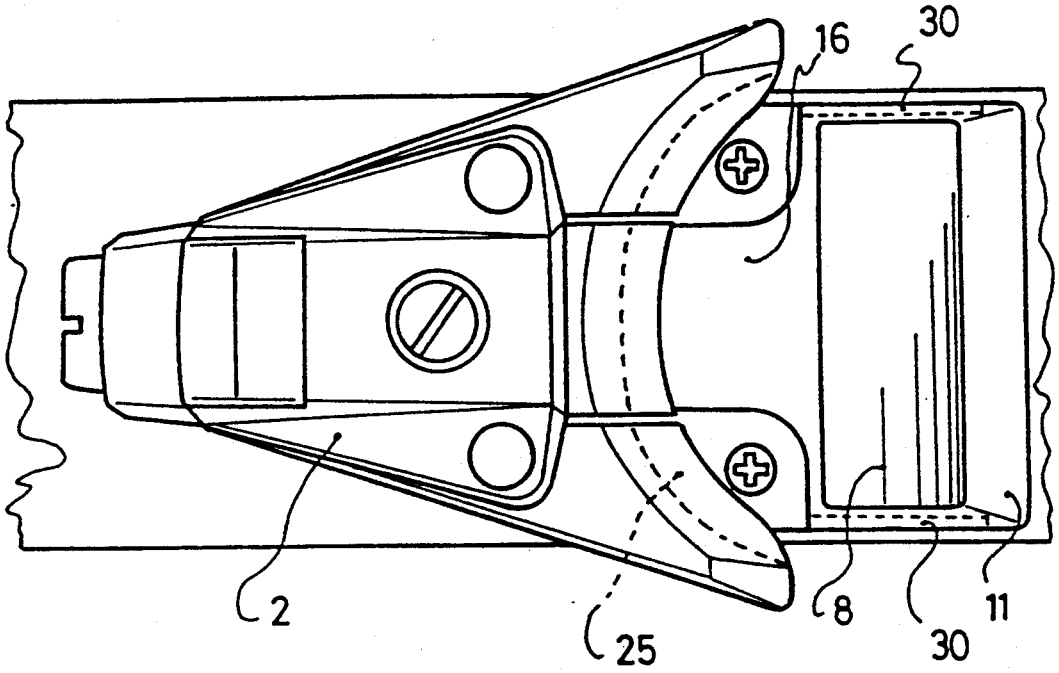
FIG. 4 is a top view of the binding of FIG. 1.

FIG. 1 illustrates a safety binding 1 of a known type which has a body 2 which rotatably moves with respect to a base 3. Base 3 is furthermore affixed to a ski 4.

Binding 1 furthermore has a jaw 5 which is adapted to receive the front end of a boot. The boot has been schematically shown in FIG. 1 in dot-and-dash lines 6. In particular, the jaw has a sole holder 25 which partially covers the front end of the sole of the boot. The sole holder 25 assures the vertical retention of the boot.

The sole of the boot 6 rests, in its front portion, on a support element 7. The support element 7 is fixedly connected to the upper surface of the ski. In FIG. 1, support plate 7 is connected to base 3 of the binding which it extends towards the rear.

Preferably, support element 7 has, at its upper portion, a sliding plate 8, formed out of a material having a low coefficient of friction. It is on this plate 8 that the sole of the boot rests. It is thus adapted to limit the friction between the sole of the boot and the ski during a lateral movement of the boot in the course of its being freed.

According to the invention the support element 7 has a base plate 9 which is in contact with the upper surface 10 of the ski, and a support plate 11 which covers the base plate 9. It is on this support plate 11 that the slide plate 8 is affixed, for example by gluing.

The support plate 11 and the base plate 9 are connected between them in a known manner, on the side of their rear end, at a zone 15 which constitutes a type of hinge.

Preferably, the support element 7 is formed out of an elastically deformable plastic material and the zone 15 thus constitutes an elastic hinge which biases the support plate 11 upwardly.

The front end 16 of the support plate 11 is free, and an abutment 19, affixed to base 3 of binding 1 limits the upward movement of this free end 16.

As shown in FIG. 1, support plate 11 is convex with a concavity oriented downwardly. Furthermore, base plate 9 has, approximately directly beneath the sliding plate 8, a rib 21 projecting upwardly, whose upper surface 22 constitutes an abutment for the support plate 11 which limits its downward vertical movement.

FIGS. 1 and 2 illustrate the rib 21 which constitutes a one piece monoblock assembly with base plate 9. It is not limiting, and rib 21 can be constituted by an applied rigid block, or by an elastically deformable block which would present shock absorption properties.

FIG. 1 illustrates support plate 11 in its uppermost position, with the free end 16 of support plate 11 abutting against abutment 19 of base 3.

FIG. 2 illustrates support plate 11 in its low position, with support plate 11 abutting against surface 22 of rib 21.

Preferably, the amplitude of movement of support plate 11, between its upper position and its lower position is in the order of about 1–3 mm.

Likewise, preferably, the elasticity of zone 15 which connects base plate 9 and support plate 11 is determined in a manner such that if an empty boot is engaged in the binding, i.e. without the foot of the skier being positioned within the boot, the return force of zone 15 is sufficient to elastically return the support plate 11 and the boot upwardly, until the front end of the sole is pinched between the sole holder 25 of jaw 5 and the support plate 11 in an elastic manner.

On the other hand, if the boot is engaged in the binding, with the foot of the skier in the boot, the support plate 11 comes to the lower position, abutting against rib 21. As a result, as is visible in FIG. 2, the upper surface 27 of the sole of the boot is disengaged from the sole holder 25 and this is achieved for soles whose thickness varies over a range substantially equal to the vertical displacement of support plate 11. In other words, for an empty boot, support plate 11 returns the boot upwardly, to abut against the sole holder 25. For a boot in which the foot of the skier present, support plate 11 is lowered into contact with the rib 21.

In this manner, one avoids a strong pinching of the sole of the boot between the support element 11 and the sole holder 25. For soles whose thickness is beyond this range, one avoids excessive pinching of the sole between the plate and the sole holder, and thus the increase of values of release of the binding due to the pinching is tolerable.

If desired, according to an alternative embodiment, the space between the support plate 11 and the base plate 9 can be filled with a material such as a closed-cell soft foam, in a manner so as to avoid infiltration of snow into this space, and to oppose a very low force, which is practically negligible, to compression.

The sealing can likewise be achieved by lateral covering walls 30 which are affixed to the support plate 11, on each of its lateral edges, in a manner such that the assembly constituted by the covering walls 30 and the support plate 11 overlaps the base plate 9. Preferably, the covering walls 30 have a height which is determined in a manner such that when the support plate 11 abuts against rib 21, walls 30 press flat against the upper surface of the ski at their lower portion.

When necessary, the covering walls 30 are part of a covering element which nests above support plate 11. In this case, the sliding plate 8 is affixed to this covering element for example by gluing.

Figure 5:
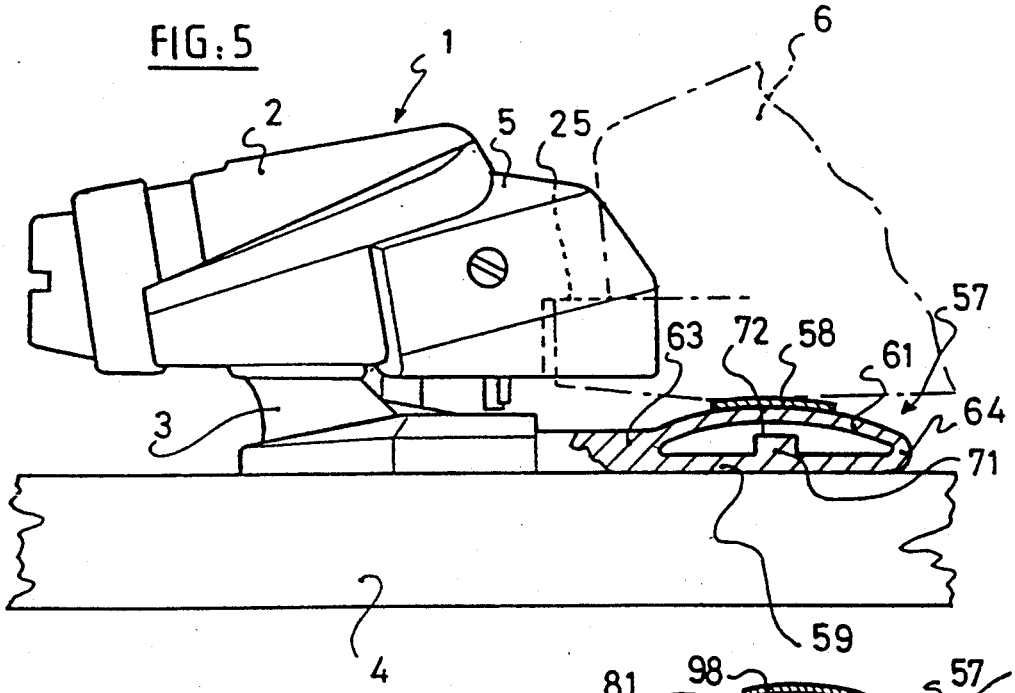
FIG. 5 illustrates, in side view, a front binding, according to another embodiment of the invention.

FIG. 5 illustrates an embodiment of the invention in which support element 57 has a base plate 59 and a support plate 61 on which is affixed the sliding plate 58. Support plate 61 is connected, in a continuous manner, to the base plate 59 at each of its front and rear ends at the level of two zones 63 and 64 which are elastically deformable, constituting respective hinge. Likewise the support plate 61 is convex with a concavity oriented downwardly, and its curvature is elastically deformable.

In the absence of a boot, the elastically deformable zones 63 and 64 elastically bias support plate 61 upwardly, and, more particularly, the central zone of this plate which carries the sliding plate 58.

Furthermore, as in the preceding case, a rib 69 is affixed to the base plate 59, substantially directly beneath the sliding surface 58, and the upper surface 72 of the rib 71 constitutes an abutment which limits the movement, downwardly, of support plate 61. Rib 71 is rigid or is constituted by a block of elastically deformable material or a shock absorption material.

Figure 6:
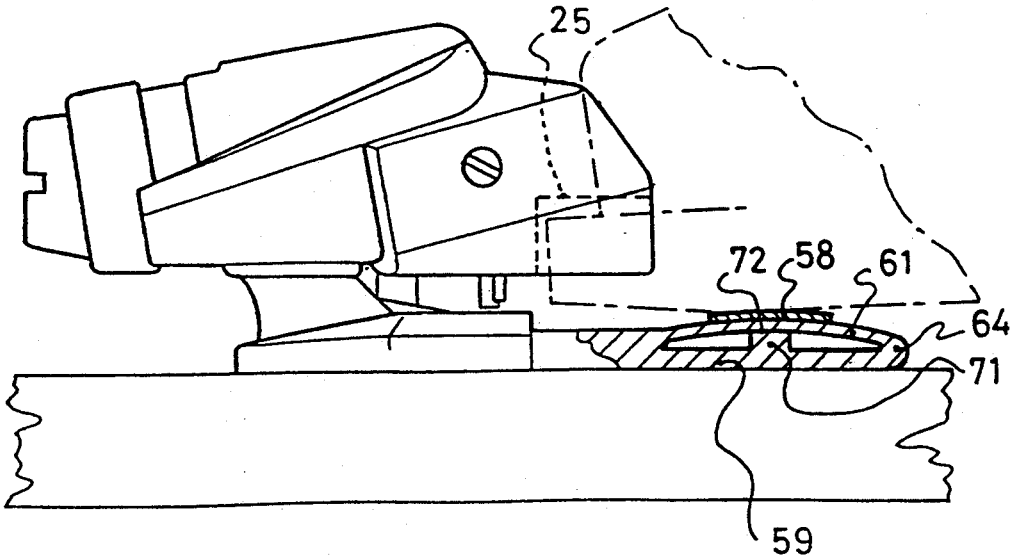
FIG. 6 illustrates the operation of the support element of FIG. 5.

The elasticity of the elastically deformable zones 63 and 64 is defined such that if an empty boot is engaged in the binding 1 i.e. without the foot of the skier being present within the boot (FIG. 5), support plate 61 brings the front of the sole to rest against the sole holder 25 of jaw 5. On the other hand, in the case where a boot is engaged in the binding, with the foot of the skier within it (FIG. 6), support plate 61 is flattened, and the elastically deformable zones 63 and 64 are deformed, until the support plate 61 abuts against rib 71.

In other words, for an empty boot, the support plate 61 returns the boot upwardly, to abut against the sole holder 25. For a boot in which the foot of the skier is present, the support plate 61 drops into contact with rib 71.

In this manner, the front end of the sole of the boot is disengaged from the sole holder 25 where the sole is pinched to only a limited extent between the sole holder 25 and support plate 61. The amplitude of movement of support plate 61 in the zone of the sliding plate 58 is on the order of 1–3 mm.

Figure 7:
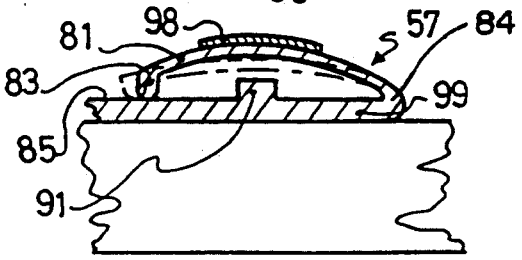
FIG. 7 illustrates another embodiment.

FIG. 7 illustrates a support element 97 whose support plate 81 and base plate 99 are connected towards the rear, and in a continuous manner by a zone 84 forming an elastic hinge.

The support plate 81 is furthermore supported on the base plate 99 at the level of its front end through a slide 83.

Support plate 81 is convex with a concavity oriented downwardly, and a rib 91 projecting with respect to the base plate 99, limits its vertical downward movement.

In the presence of a boot in which the foot of the skier is present, the support plate 81 lowers into contact with rib 91. This causes a modification of its curvature, as shown in phantom lines in FIG. 7, a movement frontwardly of slide 83 and a deflection of zone 84.

When the boot is disengaged from the binding, the support plate 81 is elastically biased and returned to the full position of FIG. 7.

Figure 8:
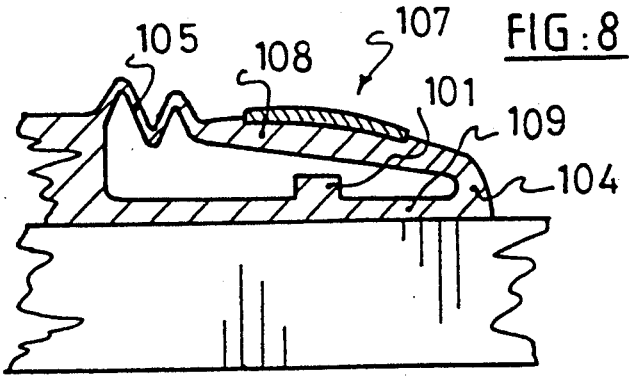
FIG. 8 relates to another embodiment.

FIG. 8 illustrates a support element 107 whose base plate 109 and support plate 108 are connected continuously through a zone 104 forming an elastic hinge. Frontwardly, the two plates 108 and 109 are connected through a deformable zone 105 constituting an elastic gusset position, whose folds are oriented in the horizontal and transverse direction.

In a preferred embodiment, the two plates 108 and 109 and the two zones 104 and 105 are monoblock made of a single piece of plastic material by molding.

Figure 9:
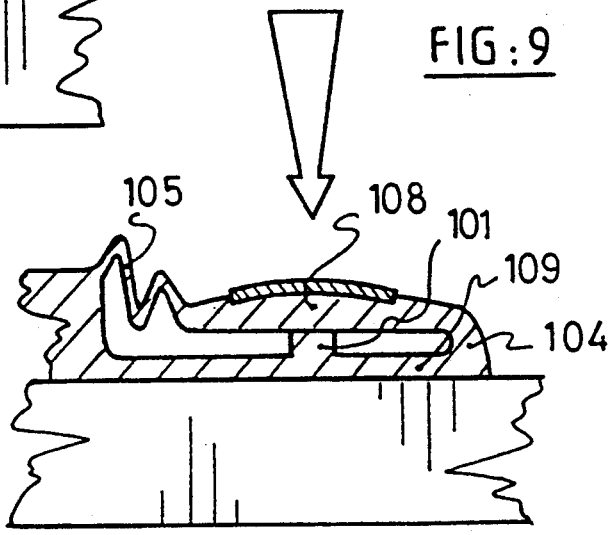
FIG. 9 illustrates the operation of the plate of FIG. 8.

FIG. 9 illustrates the behavior of support element 107 biased in compression by a boot. The support plate 108 is lowered until it abuts against rib 101 against the elastic return force of the zone forming hinge 104, as well as that of gusset portion 105. FIG. 9 illustrates that gusset portion 105 in distended position, i.e., in which it is biased in extension.

Figure 10:
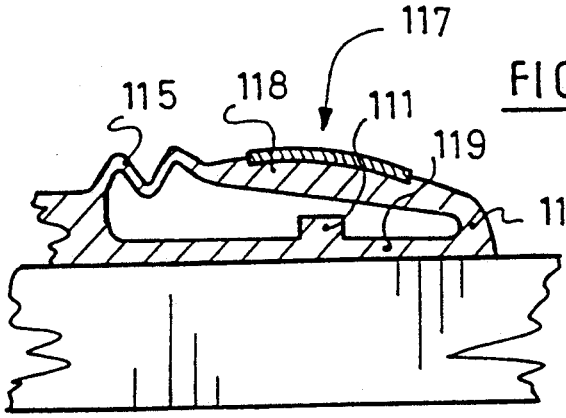
FIG. 10 relates to another embodiment.

FIG. 10 illustrates an alternative embodiment of the same type as that of FIG. 9 with a base plate 119, a support element 117 connected on one side through a zone 114 forming an elastic hinge, and on the other side by a zone 115 forming gusset. A rib 111 furthermore limits the downward movement of the support element 117.

Figure 11:
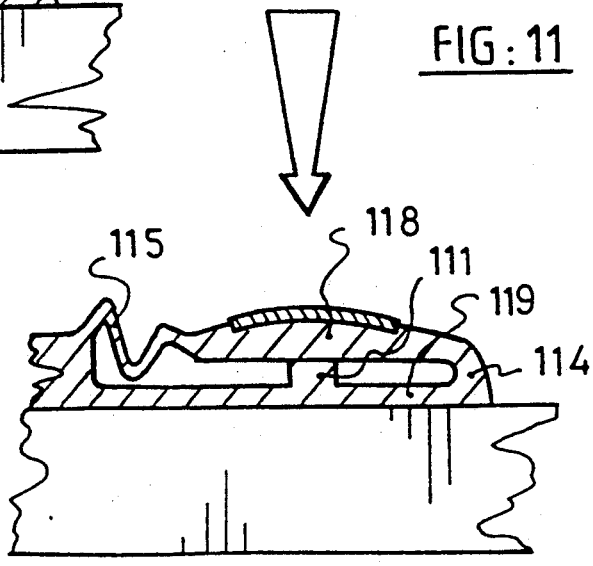
FIG. 11 illustrates the operation of the plate of FIG. 9.

In contrast to the plate shown in FIGS. 8 and 9, FIG. 11 shows that the tongue gusset 115 is here biased in compression when the support element is pressed upon by the boot.

As in the preceding case of FIG. 3, a covering element can overlap the support plate 107 in a manner so as to mask the lateral openings.

The instant application is based upon French Priority Application 89.16868 filed Dec. 18, 1989, whose priority is claimed and the disclosure of which is hereby incorporated by reference thereto.

Although the invention has been described with reference to particular means, materials and embodiments, it is to be understood that the invention is not limited to the particulars disclosed and extends to all equivalence within the scope of the claims.

What is claimed is:

1. A safety binding for a ski for retaining the front end of a boot on the ski and to release the front end when the boot exerts an excessive bias on the binding, comprising:

a base for attachment of the ski binding to the ski against movement with respect to the ski;

means for retaining the front end of the boot, said means for retaining the front end of a boot comprising a support element located to be positioned between the sole of the boot and the ski, the sole of the boot adapted to be supported by the support element;

the support element having a support plate for receiving the sole thereupon, said support plate having a length for directly supporting only a portion of the sole of the boot, and a base plate adapted to be supported against the upper surface of the ski;

the support plate being positioned above and substantially overlying the base plate when the means for retaining the front end of the boot is affixed to the ski, the support plate and the base plate being connected unitarily, through at least one elastically deformable zone forming an elastic hinge for biasing the support plate upwardly, the support plate being movable towards the base plate against the return force of the at least one elastically deformable zone under the effect of a downward force.

2. The safety binding as defined in claim 1, the base plate having a rib which projects upwardly, said rib having an upper surface constituting an abutment which limits downward movement of the support plate under the effect of the downwardly directed vertical force.

3. The safety binding as defined by claim 1, the support plate having a convex shape with a concavity oriented downwardly, the at least one elastically deformable zone comprising an elastically deformable zone at a forward end and an elastically deformable zone at a rearward end at which said support plate and said base plate are connected together.

4. The safety binding as defined by claim 1, the base having a rear portion, the rear portion of the base having an upper abutment, the support plate having a free forward end which is engageable with the upper abutment of the base of the binding during upward movement of the support plate, under the effect of the return force of the elastically deformable zone.

5. The safety binding as defined by claim 1, the support plate having a convex shape with a concavity oriented downwardly, the support plate having a forward end and a rearward end, the deformable zone being located at one of the ends, the other of the ends of the support plate comprising a free end resting against the base plate.

6. The safety binding as defined by claim 1, the support plate and the base plate having a pair of opposite lateral sides, said binding further comprising, a respective covering wall mounted on each of the sides, the support plate and the covering walls overlapping the base plate.

7. The safety binding as defined by claim 6, the covering walls having respective lower edges which are engageable against the upper surface of the ski when the support plate assumes a lowermost position.

8. The safety binding as defined in claim 2, the rib comprises an elastically deformable material.

9. The safety binding as defined by claim 1, the support plate having a forward end and a rearward end, the deformable zone being located at one of the ends, the other of the ends of the support plate comprising an extensible gusset portion, the support plate, when moved downwardly, biases the gusset portion in extension.

10. The safety binding as defined in claim 1, the support plate having a forward end and a rearward end, the deformable zone being located at one of the ends, the other of the ends of the support plate comprising a compressible gusset portion, the support plate, when moved downwardly, biases the gusset portion in compression.

11. A support apparatus for a ski binding in which the ski binding includes jaws for engagement with a sole of a ski boot, a base for attachment of the ski binding to the ski against movement with respect to the ski, said support apparatus comprising a support element, the support element comprising:

a support plate for receiving the sole of a ski boot, the support plate having a first end and a second end;

a base plate for being positioned against the ski, the base plate having a first end and a second end;

the support plate being unitary with the base plate at least at respective first ends of the support plate and the base plate to form a hinge portion;

the support plate being positioned above and substantially overlying the base plate;

at least the hinge portion being elastically deformable and comprising means for biasing the support plate against the sole of the boot and for permitting movement of the support plate downwardly, with respect to the jaws of the binding, against the effect of a downward force.

12. The support apparatus of claim 11, the base having an upper abutment, the second end of the support plate comprising a free end, the free end of the support plate being engagable with the upper abutment of the base in an upper position of the support plate.

13. The support apparatus of claim 11, the second end of the support plate being unitary with the second end of the base plate.

14. The support apparatus of claim 11, further comprising an abutment between the support plate and the base plate, the abutment comprising means for limiting movement of the support plate toward the base plate.

15. The support apparatus of claim 14, the abutment being unitary with the base plate.

16. The support apparatus of claim 11, the second end of the support plate comprising a free end, the free end of the support plate being in engagement with the base plate in both a lowermost position and an uppermost position.

17. These support apparatus of claim 11, the support plate having a first side and a second side and the base plate having a first side and a second side, the support apparatus further comprising a first covering wall on the first side of the support plate and the first side of the base plate and a second covering wall on the second covering wall on the second side of the support plate and the second side of the base plate.

18. The support apparatus of claim 11, further comprising a gusset portion connected to the second end of the support plate, the gusset portion being deformable to permit movement of the support plate with respect to the base plate.

19. The support apparatus of claim 18, the gusset portion, the support plate and the base plate being formed of a unitary material.

20. The support apparatus of claim 18, the gusset portion being in tension in a lowermost position of the support plate.

21. The support apparatus of claim 18, the gusset portion being in compression in a lowermost portion of the support plate.

22. The support apparatus of claim 18, further comprising a base, the gusset portion connecting the support plate to the base.

23. The support apparatus of claim 22, the base, the gusset portion, the support plate and the base plate being formed of a unitary material.

24. The support apparatus of claim 18, further comprising an abutment positioned between the support plate and the base plate for limiting movement of the support plate toward the base plate.

25. The support apparatus of claim 18, the gusset portion comprising a number of folds extending transversely from one side to another side of the gusset portion.

26. The support apparatus of claim 11, further comprising a low-friction surface on the support plate for engagement with the sole of the boot.

27. The support apparatus of claim 11, said support plate having an amplitude of movement, between an uppermost position and a lowermost position of about 1–3 millimeters.

28. The support apparatus of claim 12, the base and the base plate being unitary.

* * * * *